US005405496A

United States Patent [19]

Hedblom et al.

[11] Patent Number: 5,405,496

[45] Date of Patent: Apr. 11, 1995

[54] PROCESS FOR THE PREPARATION OF COOKING LIQUORS HAVING HIGH SULPHIDITY FOR SULPHATE PULP COOKING

[75] Inventors: Mats-Olov Hedblom, Avesta; Hans Lindberg, Stockholm, both of Sweden

[73] Assignee: Chemrec AB, Karlstad, Sweden

[21] Appl. No.: 176,694

[22] Filed: Jan. 3, 1994

Related U.S. Application Data

[63] Continuation of Ser. No. 849,385, Jun. 30, 1992, abandoned.

[30] Foreign Application Priority Data

Nov. 23, 1989 [SE] Sweden ..... 8903953

[51] Int. Cl.[6] ..... D21C 11/12

[52] U.S. Cl. ..... 162/31; 162/30.1; 162/30.11; 423/207; 423/DIG. 3

[58] Field of Search ..... 162/30.1, 30.11, 31; 423/207, DIG. 3

[56] References Cited

U.S. PATENT DOCUMENTS

| | | | |
|---|---|---|---|
| 2,106,952 | 2/1938 | Konig | 23/134 |
| 3,822,180 | 7/1974 | Mita et al. | 162/36 |
| 3,867,251 | 2/1975 | Holme | 162/30.1 |
| 4,098,639 | 7/1978 | Noreus et al. | 162/30 K |
| 4,451,333 | 5/1984 | Bourson et al. | 162/77 |
| 4,710,269 | 12/1987 | Santen et al. | 162/30.1 |
| 4,786,365 | 11/1988 | Teder et al. | 162/65 |
| 4,808,264 | 2/1989 | Kignell | 162/30.11 |
| 5,061,343 | 10/1991 | Azarniouch et al. | 162/30.11 |

OTHER PUBLICATIONS

Norden, Solveig "Modified Kraft Processes For Softwood Bleached-grade Pulp", TAPPI, Jul. 1979, vol. 2, 7, pp. 49–51.

*Primary Examiner*—W. Gary Jones
*Assistant Examiner*—Dean T. Nguyen

[57] ABSTRACT

The invention relates to a process for preparation, under reducing conditions, of cooking liquors having high sulphidity for sulphate pulp cooking, wherein the black liquor obtained in the cooking process is fed, after evaporation, completely or partly to a reactor operating at increased temperature which is obtained by energy supply from an external heat source and/or release of energy from the black liquor, a melt essentially consisting of sodium sulphide being formed and withdrawn to be further processed to cooking liquor. The process of the invention is characterized in that in addition there are fed to the reactor the whole or part of sulphur-containing and/or sulphur- and sodium-containing materials present in the pulp mill, including sulphur-containing and/or sodium- and sulphur-containing make-up chemicals used for the total chemicals balance of the pulp mill, in such a way that the mole ratio of sodium to sulphur in the total mixture fed to the reactor is within the range of 1.5 to 4. According to a preferred embodiment of the invention there is used an aqueous solution of the sodium sulphide melt obtained in so-called modified sulphate cooking.

12 Claims, No Drawings

PROCESS FOR THE PREPARATION OF COOKING LIQUORS HAVING HIGH SULPHIDITY FOR SULPHATE PULP COOKING

This application is a continuation of application Ser. No. 07,849,385, filed Jun. 30, 1992, now abandoned.

The present invention relates to a process for the preparation of cooking liquors having high sulphidity for the sulphate pulp industry starting from chemicals available in the pulp mill or make-up chemicals common in the pulp mill.

The invention considers the important pulp mill balance between sodium and sulphur and is particularly advantageous in cooking with high sulphidity, particularly in so-called modified cooking.

By passing, together with black liquor, other sodium and sulphur containing materials present in the pulp mill to a reactor in such a way that the mole ratio of sodium to sulphur falls within the range 1.5 to 4, it is possible under reducing conditions to prepare a melt of sodium sulphide ($Na_2S$) having a lower content of sodium carbonate than in a conventional soda recovery unit melt. From a solution, of this melt a cooking liquor having very high sulphidity may be prepared. At a sodium to sulphur ratio of 2 to 3 the carbonate content is so low that the solution may be used directly for cooking purposes.

Sodium sulphide and the closely related chemical sodium hydrogen sulphide are often interchangeable with each other and the application thereof often differs in order to meet different sulphidity demands. In the aqueous phase sodium sulphide hydrolyzes completely or partly to sodium hydroxide and sodium hydrogen sulphide according to $$Na_2S + H_2O \rightarrow NaOH + NaSH \quad (1)$$

The concept sulphidity in the pulp industry is usually expressed as $$\text{sulphidity (\%)} = \frac{2 \times NaSH}{NaOH + NaSH} \times 100$$

wherein NaSH and NaOH are expressed in molar units. This means e.g. that an aqueous solution containing sodium hydrogen sulphide and sodium hydroxide-having a sulphidity of 40% contains 4 times more moles of sodium hydroxide than sodium hydrogen sulphide, In the same way the equilibrium (1) expresses a solution having a sulphidity of 100%.

Large amounts of sodium sulphide are prepared in the sulphate pulp industry. When recovering the cooking chemicals the so-called black liquor is burnt in a soda recovery unit the lower part of which is reductive, in the lower zone of the soda recovery unit the sulphur components of the black liquor are reduced to the sulphide state and accordingly convert to sodium sulphide. The sulphate pulp mills often operate within the sulphidity range of 25 to 40% (white liquor sulphidity). A major part of the sodium reacts with carbon dioxide when burning black liquor to form sodium carbonate. The mixture of sodium sulphide and sodium carbonate forms a melt at the bottom of the soda recovery unit and this melt is withdrawn and is reacted with water to form so-called green liquor. A typical green liquor has the composition Sodium carbonate 90–105 g/l
Sodium sulphide 20–50 g/l
Sodium hydroxide 15–25 g/l
(all substances calculated as sodium hydroxide).

Chemicals recovery according to the "sulphate process" (kraft) results in that a relatively large amount of sulphur reaches the oxidative zone and is rejected from the soda recovery unit mainly as sodium sulphate (electrical filter ash) and sulphur dioxide, If the white liquor sulphidity exceeds 35% problems begin to arise i.a. by high emissions of sulphur dioxide from the soda recovery unit. Scrubbing with alkaline medium is therefore often used in order to eliminate or strongly reduce the sulphur dioxide emissions. The green liquor obtained is converted to white liquor according to the known causticizing process. The composition of a white liquor may vary from mill to mill but approximate concentration values are Sodium hydroxide, NaOH 80–120 g/l
Sodium sulphide, $Na_2S$ 20–50 g/l
Sodium carbonate, $Na_2CO_3$ 10–30 g/l
Sodium sulphate, $Na_2SO_4$ 5–10 g/l
(all substances calculated as sodium hydroxide).

If $Na_2S$ is estimated to be fully hydrolyzed according to $$Na_2S + H_2O \rightarrow NaOH + NaSH$$

this means that the amount of sodium, bound as carbonate, often amounts to more than 20% of the sodium present as hydroxide.

It is known that the presence of sodium hydrogen sulphide is advantageous in pulp cooking according to the sulphate process. The presence of sodium hydrogen sulphide increases the selectivity of the cooking towards higher lignin release. The effect can also be expressed by saying that an increased hydrogen sulphide content makes its possible to reach a lower kappa number at the same viscosity when the conditions otherwise are comparable.

The kappa number is a measure of the lignin content and the viscosity is considered to be a measure of the strength of the cellulose fiber.

It is of interest to be able to cook the pulp to as low kappa number as possible. This especially applies if it shall be bleached to high (90 ISO) brightness. For this purpose there is required bleaching with chlorine-containing bleaching chemicals resulting in synthetic chlorine-carbon bonds (TOCl—total organic chlorine bound) which are a great environmental load. In order to reduce the proportion of lignin bleached-off with chlorine-containing bleaching chemicals, bleaching with an oxygen gas has also been developed. This technique is in the process of development in i.a. Sweden and Japan.

In order to reduce the bleaching with chlorine chemicals it is known to further improve the selectivity of the cooking by so-called modified cooking resulting in still lower kappa numbers. Modified cooking according to the present technique is based upon the following process conditions:

1. The alkali concentration shall be as constant as possible during the course of the cooking.
2. The hydrogen sulphide concentration shall be as high as possible, particularly in the beginning of the bulk delignification phase. The hydrogen sulphide concentration can be low at the end phase of the cooking.

3. The concentrations of lignin released and sodium ions shall be as low as possible, particularly in the last stage of the cooking.
4. The temperature shall be low, particularly in the beginning and at the end of the cooking.

Of the above-cited items, item 2 is of special interest with regard to the present invention. So far one has been allowed to content with the concentration of hydrogen sulphide ions provided by the 40% sulphidity in the white liquor.

From i.a. S. Norden et al, Tappi, Vol 62, No 7, July 1979, p. 49; B. Johansson et al, Svensk Papperstidning No 10, 87 (1984), p. 30; and D. Tormund et al, Tappi, Vol 72, No 5, May 1989,p. 205, it is evident that a further increased content of hydrogen sulphide ions beyond 40% sulphidity is very advantageous in the initial stage of the cooking.

In modified cooking the cooking liquor is added at two or several places. An extra high sulphidity in the cooking liquor added in the beginning of the cooking is of greatest use while the sulphidity in cooking liquors added in the final phase of the cooking may be low.

We have now surprisingly found a process for preparing a cooking liquor having high sulfidity which is particularly suited for modified cooking according to the sulphate process, wherein cooking liquor having high sulphidity is added in such way that when cooking according to prior art, one may prepare pulp with lower kappa number than normally is obtained. More particularly, the invention relates to a process for preparing, under reducing conditions, cooking liquors having high sulphidity for sulphate pulp cooking wherein the black liquor formed in the cooking process is passed, after evaporation, completely or partly to a reactor operating at an increased temperature which is obtained by energy supply from an external heat source and/or release of energy from-the black liquor, a melt essentially consisting of sodium sulphide being formed and withdrawn to be further processed to cooking liquor. The process of the invention is characterized in that in addition there are added to the reactor the whole or part of the sulphur-containing and/or sulphur- and sodium-containing materials present in the pulp mill, including sulphur-containing and/or sodium- and sulphur-containing make-up chemicals used for the total chemicals balance of the pulp mill, in such a way that the mole ratio of sodium to sulphur in the total mixture fed to the reactor is within the range from 1.5 to 4.

Preferably one seeks to obtain mole ratios of sodium to sulphur in the total mixture fed to the reactor within the range from 2 to 3 and most preferably within the range from 2 to 2.8. Further, it is preferred to feed to the reactor up to about 30% of the black liquor stream formed in the pulp mill.

The sodium sulphide melt obtained in the process of the invention may be dissolved in water and further processed to cooking liquor in a way known per se. According to a preferred embodiment a solution of the melt is fed directly to the digester for optimum use of its high sulphidity in modified cooking. In an alternative process a solution of the melt is mixed with part of the white liquor prepared in the usual way.

In order to allow the reduction reactions in the reactor to proceed fast and accordingly obtain shorter residence times and small reactor volumes, additional energy, in addition to the energy released from the black liquor in partial oxidation, can be supplied to the mixing zone of the reactor by a hot gas, the heat content and oxidation potential of which are adjusted to the reduction work required. The heat energy may e.g. be supplied by a gas heated by a plasma generator. The very not gas or gas mixture can also be formed directly or indirectly with an oxy-fuel burner.

As gas or gas mixture use can be made of air, recirculating process gas, hydrogen gas, natural gas, carbon monoxide, etc. When using an oxy-fuel burner the gas or gas mixture is obtained by combustion of e.g. acetylene or liquified petroleum gas with oxygen enriched air or pure oxygen gas.

A preferred process according to the invention is that the hot gas is fed to the reactor close to the material fed which in turn must be finely divided which can be obtained by different kinds of atomization techniques known by the man skilled in the art. The design of the reactor must be sufficiently large in order for the reaction to have time to take place, i.e. the reactor volume musk ensure a certain minimum residence time.

The reactor is preferrably a closed reaction vessel and the temperature in the reactor shall be at least the temperature at which the sodium sulphide is formed under otherwise prevailing conditions. The man skilled in the art may establish said temperature from case to case, e.g. by routine experiments. The temperature is preferrably not below 700° C.

The pressure in the reactor is preferrably atmospheric pressure. However, the process may be effected at an increased pressure, e.g. in order to reduce the reactor volume.

In Swedish Patent SE 8501465-2 there is disclosed a process to relieve the soda recovery unit by means of plasma gasification of a partial stream of the black liquor. This makes its possible to increase the pulp production in a mill having too small a soda recovery unit capacity or e.g. to introduce oxygen gas bleaching and/or modified cooking in a mill restricted in soda recovery unit capacity without loosing production capacity.

Of essential importance for the process of the invention is that the mole ratio of sodium to sulphur in the total mixture fed to the reactor is below about 4 and is within the range from 1.5 to 4, preferrably from 2 to 3. This adjustment of the sodium to sulphur ratio is effected by means of sulphur-containing and/or sulphur- and sodium-containing materials present in the pulp mill, including sulphur-containing and/or sodium- and-sulphur-containing make-up chemicals used for the total chemicals balance of the pulp mill.

The make-up chemicals used in order to adjust the mole ratio of sodium to sulphur correctly may consist of sulphur, sulphur dioxide, sulphuric acid, sodium hydrogen sulphate, sodium sulphate, sodium sulphite, sodium hydrogen sulphite and sodium thiosulphate.

Among sulphur-containing and/or sulphur- and sodium-containing materials present in the pulp mill the following can be mentioned:

a. Residual acid from chlorine dioxide production. From so-called Mathieson plants there is obtained a mixture of sulphuric acid and sodium sulphate having a Na/S ratio of $\leqq 1$. In other common processes of so-called R-8 type sodium sesquisulphate ($Na_3H(SO_4)_2$) having a Na/S ratio of 1.5 is formed. The deposition of the residual acid is generally a problem. It often has to be dumped.
b. So-called electrical filter ash which mainly consists of sodium sulphate. There are normally formed from 60 to 125 kg electrical filter ash per ton of pulp which are recirculated to the combustion zone of the soda recovery unit. The Na/S ratio is ≦2.

c. Sulphate-containing solutions from soda recovery unit scrubber. The Na/S ratio is about 2.

d. In EP 87850238.4 there is disclosed a process wherein a partial stream of the sodium hydrogen sulphide of the white liquor is reacted with copper oxide, sodium hydroxide and copper sulphide being formed. The copper sulphide is roasted to form sulphur dioxide and copper oxide. The sulphur dioxide formed is a sodium-free sulphur source.

Further, elemental sulphur may be used or any other sulphur-containing chemical having a Na/S ratio being equal to or below about 4.

By suitable combinations of the whole or part of the black liquor stream and one or more of the above-stated products a non-unessential amount of cooking liquor having high sulphidity can be prepared.

The invention is further illustrated by means of the following working examples.

EXAMPLE 1

The following material streams were fed continuously per hour to a reactor operating at atmospheric pressure.

620 kg black liquor (65% dry substance content) containing 129 kg sodium (Na) and 35 kg sulphur (S) per ton of black liquor.

a residual acid mixture from chlorine dioxide production according to the Mathieson process containing 80 kg $H_2SO_4$ and 62 kg $Na_2SO_4$.

800 kg $Na_2SO_4$ in the form of electrical filter ash.

The above material streams were mixed with-an oxygen-containing gas and passed to a reaction room. The oxygen-containing gas was heated to about 750° C. in a plasma generator.

By partial oxidation of the black liquor energy was released, the temperature in the reactor being maintained at about 950° C.

The process gas evolved at the partial oxidation was cooled. After any final oxidation, heat recovery as well as scrubbing the gas may be released to the atmosphere.

Alternatively, a major part of the energy content of the liquor may be released by partial oxidation whereby it is not necessary to preheat the oxygen-containing gas in a plasma generator.

In the reaction room incoming sulphur compounds are reduced essentially to sodium sulphide ($Na_2S$) forming a melt phase which is withdrawn from the system.

Owing to the high partial pressure of sulphur in the reaction room and the higher affinity of sulphur to sodium compared to carbon dioxide at the prevailing reaction conditions, the formation of sodium carbonate is suppressed in the inorganic melt phase.

From the melt prepared there is prepared 4.0 molar solution with regard to sodium containing 1.85 moles of NaOH, 1.85 moles NaSH and 0.15 moles $Na_2Co_3$ per liter.

In preparation of experiments with modified two-step pulp cooking where 70% of the cooking chemicals where charged in step 1 and the residual 30% in step 2, the following cooking liquors where prepared.

One (1) part of the liquor obtained above according to the invention was mixed with 4.63 parts of ordinary cooking liquor (white liquor) containing 2.8 moles of NaOH and 0.7 moles of NaSH per liter solution. The cooking liquor thus prepared having a sulphidity amounting to 51% was charged in the first cooking step, whereas the normal white liquor having a sulphidity of 40% was charged in step 2.

EXAMPLE 2

The following material streams where fed continuously per hour to a reactor operating at atmospheric pressure 566 kg black liquor (65% dry substance content) containing 129 kg sodium (Na) per ton and 35 kg sulphur (S) per ton 48 kg sulphur dioxide 80 kg $Na_2S0_4$ in the form of electrical filter ash 25 kg of $Na_2SO_4$ as make-up.

One proceeded in exactly the same way as in Example 1 and obtained a melt phase which that was withdrawn from the system.

The sulphur dioxide added had been generated by roasting according to the process for preparation of sulphide-free liquor disclosed in EP 87850238.4. From the melt prepared there was prepared a 4.0 molar solution with regard to sodium containing 1.7.5 moles of NaOH, 1.75 moles of NaSH and 0.25 moles of $Na_2CO_3$.

In preparation of experiments with modified two-step pulp cooking where 70% of the cooking chemicals where charged in step 1 and the residual 30% in step 2, the following cooking liquors were prepared.

According to the same charging process as in Example 1, in mixing 1.0 part of the liquor prepared above with 1,14 parts of ordinary cooking liquor (white liquor) (40% sulphidity) one obtained a cooking liquor having a sulphidity of 68%. This liquor was charged in the first cooking step.

In the other step use was made of the sulphide-free liquor prepared according to EP 87850238.4.

We claim:

1. A process for preparing, under reducing conditions, cooking liquors for sulphate pulp cooking, wherein black liquor formed in the cooking process is fed, after evaporation, completely or partly to a black liquor gasifier operating at 700°–950° C. which is obtained by energy supply from an external heat source and/or release of energy from the black liquor, to form a melt having a low sodium carbonate content, which melt is formed and withdrawn to be further processed to cooking liquor, the process comprising feeding to the black liquor gasifier the whole or a part of sulphur-containing and/or sulphur- and sodium-containing materials present in connection with pulp production in such amounts that the mole ratio between sodium and sulphur in the total mixture fed to the gasifier is within the range of 1.5 to 4 to form a melt solution containing 0.25 moles per liter or less of sodium carbonate.

2. The process of claim 1, wherein the mole ratio between sodium and sulphur in the total mixture fed to the reactor is within the range of 2 to 3.

3. A process according to claim 2 wherein the mole ratio is within the range of 2–2.8.

4. The process of claim 1, wherein the sulphur-containing and/or sulphur- and , sodium-containing materials present in connection with pulp production and fed to the reactor partly or completely consist of one, more or all of filter ash, residual product from chlorine dioxide production, sodium hydrogen sulphite containing solutions from scrubbing of sulphur dioxide, waste liquors from CTMP, NSSC or other sulphite pulp processes, sulphur dioxide from roasting of copper sulphide, hydrogen sulphide containing condensates and/or air streams, sulphur, sulphur dioxide, sulphuric acid, sodium sulphite, sodium hydrogen sulphate, sodium thiosulphate and sodium sulphate.

5. The process of claim 1, wherein the melt or an aqueous solution thereof is mixed with white liquor, a white liquor having increased sulphidity being obtained.

6. The process of claim 1, wherein an aqueous solution of the melt is used in so-called modified sulphate cooking.

7. A process according to claim 1 wherein the mole ratio between sodium and sulfur in the total mixture said to the reactor is within the range of 2 to 3.

8. A process according to claim 1 wherein the sulfur-containing and/or sulfur and sodium-containing materials present in connection with pulp production and fed to the reactor partly or completely consist of one, more or all of filter ash, residual product from chlorine dioxide production, sodium hydrogen sulphite containing solutions from scrubbing of sulphur dioxide, waste liquors/from CTMP, NSSC or other sulphite pulp processes, sulphur dioxide from roasting of copper sulphide, hydrogen sulphide containing condensates and/or air streams, sulphur, sulphur dioxide, sulphuric acid, sodium sulphite, sodium hydrogen sulphate, sodium thiosulphate and sodium sulphate.

9. A process according to claim 1 wherein the melt or an aqueous solution thereof is mixed with white liquor, a white liquor having increased sulfidity being obtained.

10. The process according to claim 1 wherein an aqueous solution of the melt is used in so-called modified sulfate cooking.

11. The method of claim 1 wherein the sulphur-containing and/or sulphur- and sodium-containing materials are selected from the group consisting of electrostatic precipitator ash, hydrogen sulfide containing gases and mixtures thereof.

12. A process for preparing, under reducing conditions, cooking liquors for sulphate pulp cooking, wherein black liquor formed in the cooking process is fed, after evaporation, completely or partly to a black liquor gasifier operating at 700°–950° C. which is obtained by release of energy from the black liquor without the necessity of supplying an external heat source, to form a melt having a low sodium carbonate content, which melt is formed and withdrawn to be further processed to cooking liquor, the process comprising feeding to the black liquor gasifier the whole or a part of sulphur-containing and/or sulphur- and sodium-containing materials present in connection with pulp production in such amounts that the mole ratio between sodium and sulphur in the total mixture fed to the gasifier is within the range of 1.5 to 4 to form a melt solution containing 0.25 moles per liter or less of sodium carbonate.

* * * * *